US005172482A

United States Patent [19]

Coleman

[11] Patent Number: 5,172,482

[45] Date of Patent: Dec. 22, 1992

[54] DRAWING INSTRUMENT

[75] Inventor: Cynthia E. Coleman, New York, N.Y.

[73] Assignee: Align Incorporated, New York, N.Y.

[21] Appl. No.: 827,331

[22] Filed: Jan. 29, 1992

[51] Int. Cl.[5] ..... B43L 7/04

[52] U.S. Cl. ..... 33/449; 33/561.1

[58] Field of Search ..... 33/449, 448, 489, 474, 33/561.1; 16/21, 24, 26

[56] References Cited

U.S. PATENT DOCUMENTS

| | | | |
|---|---|---|---|
| 1,584,839 | 5/1926 | Cameron . | |
| 2,234,467 | 3/1941 | De Lisle . | |
| 2,707,301 | 5/1955 | Urso | 16/24 |
| 2,752,685 | 7/1956 | Zauner . | |
| 3,096,536 | 7/1963 | Rabelos | 16/24 X |
| 3,225,445 | 12/1965 | Duggan . | |
| 3,462,846 | 8/1969 | Goerz . | |
| 3,747,217 | 7/1973 | Middlebeek . | |
| 4,670,991 | 6/1987 | McKay et al. . | |
| 4,821,424 | 4/1989 | Loggins . | |
| 4,926,564 | 5/1990 | Loggins . | |
| 4,999,922 | 3/1991 | Loggins . | |

FOREIGN PATENT DOCUMENTS

| | | | |
|---|---|---|---|
| 315916 | 10/1956 | Switzerland | 33/449 |

*Primary Examiner*—Harry N. Haroian

*Attorney, Agent, or Firm*—Silverman, Cass & Singer, Ltd.

[57] ABSTRACT

A non-marring drawing instrument includes a rolling member for supporting the body of the instrument on a drawing surface in spaced apart relation thereto. The rolling member is mounted on the body for movement between respective rolling and locked positions of the member projecting from the body. A resilient member constrains the rolling member in its rolling position, for rolling movement of the instrument on the drawing surface, and yields for movement of the rolling member into its locked position. Frictional braking structure, which may include the resilient member, engages the rolling member in its locked position, for immobilizing the instrument. Braking is accomplished by pressing the instrument body towards the drawing surface.

11 Claims, 3 Drawing Sheets

DRAWING INSTRUMENT

BACKGROUND OF THE INVENTION

This invention relates to drawing instruments, more particularly, to instruments having a lessened tendency to mar a drawing surface in use.

Drawing instruments such as triangles, T-squares and others are typically laid flat on a drawing surface with the entire area of the face of the instrument in contact with the surface. This leads to problems of smearing of pencilled or inked lines of a drawing, and of smearing or grinding debris from the drawing process, e.g., graphite and eraser residue, on or into the drawing surface, when the instrument slides thereacross. Also, ink tends to bleed under the edge of a flat-lying instrument used as a guide for scribing inked lines.

Previous attempts to alleviate the foregoing marring problems have included the provision of instrument-carried supports to space the instrument a slight distance from the drawing surface. The area of the supports in contact with the drawing surface is made substantially smaller than the face area of the instrument.

Fixed instrument supports, such as protuberances on the face of an instrument have been disclosed. However, the rubbing contact of even the small contact area of a protuberance with a drawing surface may cause marring.

Instrument supports are known which roll on the drawing surface, thus reducing rubbing friction thereon. These supports include rollable balls, and cylindrical rollers or wheels, revolving about an axis of rotation. The ball-type supports permit easy omni-directional relative movement over a drawing surface. The simple roller or wheel-type supports may be less advantageous, when they are easily rollable only in directions normal to the axis of rotation.

Prior drawing instruments having rolling members supporting an instrument body for movement over a drawing surface may be lacking, deficient, and/or disadvantageous in provisions for rendering the instrument immobile when used for drawing purposes, particularly while supporting the body in spaced apart relation to the drawing surface for avoidance of marring.

SUMMARY OF THE INVENTION

An important object of the invention is to provide a drawing instrument having a lessened tendency to mar a drawing surface over which the instrument is moved relative to the surface.

Another object is to provide such an instrument having relatively low frictional resistance to such movement.

Yet another object is to provide such an instrument which is easily moved to a desired position on a drawing surface, and which also readily may be rendered stable and immovable when used.

A further object is to provide a drawing instrument having a rolling member supporting an instrument body for relative movement over a drawing surface in spaced apart relation thereto, and having new and improved means for immobilizing the instrument with the body in spaced apart relation to the drawing surface when used for drawing purposes.

A still further object is to provide such an instrument which is simple to use, may be used accurately, and is economical to manufacture.

In preferred embodiments, the invention provides a drawing instrument including an instrument body and a rolling member adapted for supporting the body on a drawing surface. Means are provided for mounting the rolling member on the body for relative movement to and from the body between respective rolling and locked positions of the member projecting from the body. Resilient means on the body yield for relative movement of the rolling member into the locked position upon application of pressure to the body in the direction of the drawing surface. Frictional braking means on the body engage the rolling member in its locked position. The instrument thereby may be moved relatively on a drawing surface on which the body is supported with the rolling member in its rolling position and rendered substantially immobile with the rolling member in its locked position, while the instrument body remains in spaced apart relation to the drawing surface.

In a further preferred embodiment, a cartridge assembly carried by the body includes the resilient means and the rolling member.

In another preferred embodiment, the body of the instrument is of laminar construction and includes at least a relatively thick base lamina and a relatively thin skin lamina, and the mounting means are carried in the base lamina.

BRIEF DESCRIPTION OF THE DRAWINGS

The attached drawings illustrate preferred embodiments of the invention, without limitation thereto. In the drawings, like elements are identified by like reference symbols in each of the views.

DESCRIPTION OF THE PREFERRED EMBODIMENTS

Figure 1:
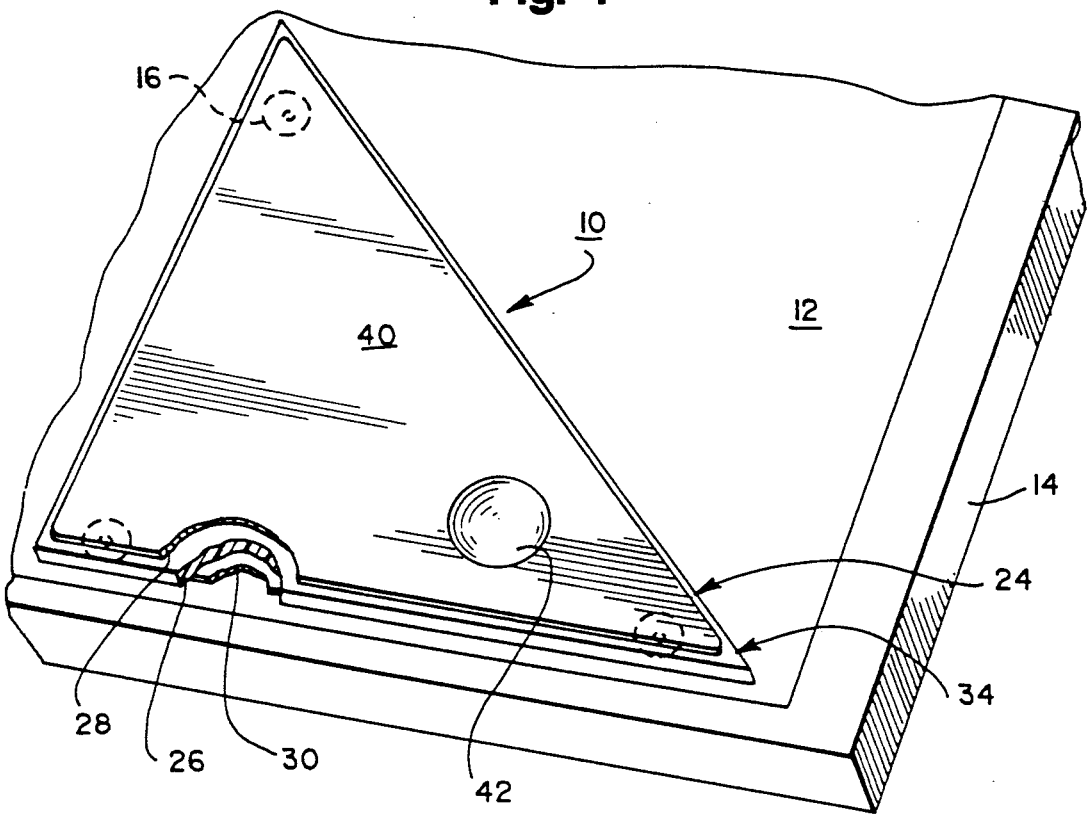
FIG. 1 is a top perspective view of a drawing instrument in accordance with one embodiment of the invention, shown in operating position on a drawing surface.
Figure 2:
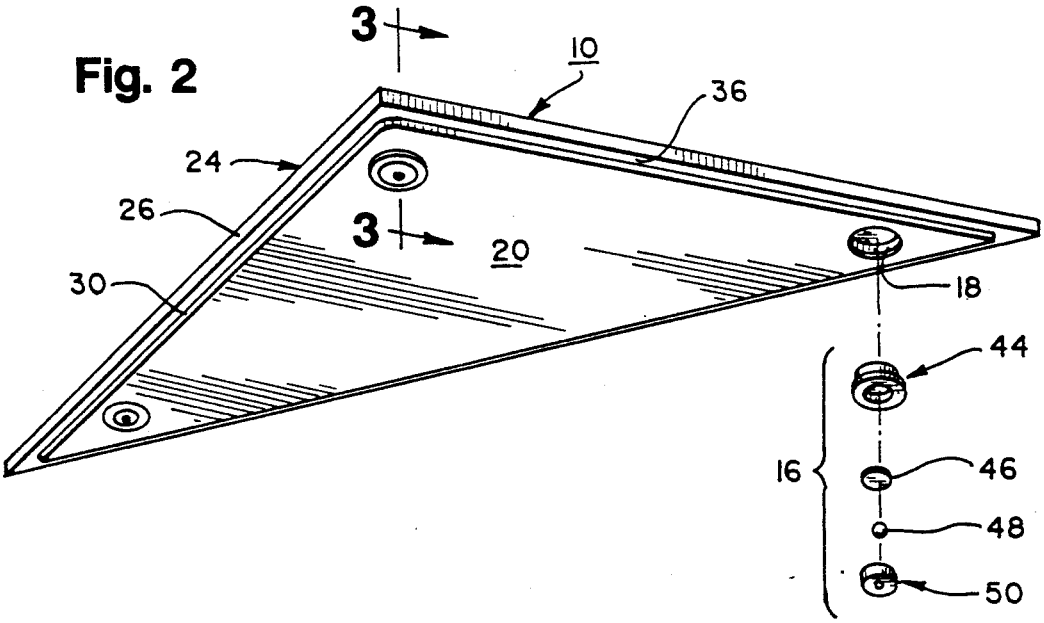
FIG. 2 is a bottom perspective view of the instrument with a cartridge assembly thereof shown in exploded perspective view.

Referring to FIGS. 1–2, a drawing instrument constructed in accordance with the invention and constituting a drawing or draftsman's triangle 10 is shown extending in operative position over a drawing surface 12, such as a sheet of paper or the like. The paper lies on a drawing board 14.

The triangle 10 includes a triangular body 24 and a cartridge assembly 16 carried by the body adjacent to each vertex thereof for support of the body in spaced apart relation above the drawing surface 12. The assemblies 16 are carried in respective blind bores or recesses 18 formed in the body 24 and extending inwardly thereinto from a bottom or inner face surface 20 thereof.

The triangle body 24 preferably is of laminated construction, and it comprises a relatively thick central lamina 26 and relatively thin upper and lower, or outer and inner, skin laminae 28 and 30, respectively. The central lamina 26 preferably is made of relatively rigid material, such, for example, as acrylic plastic. The central lamina 26 has substantially planar, upper and lower surfaces 34 and 36, respectively.

Figure 3:
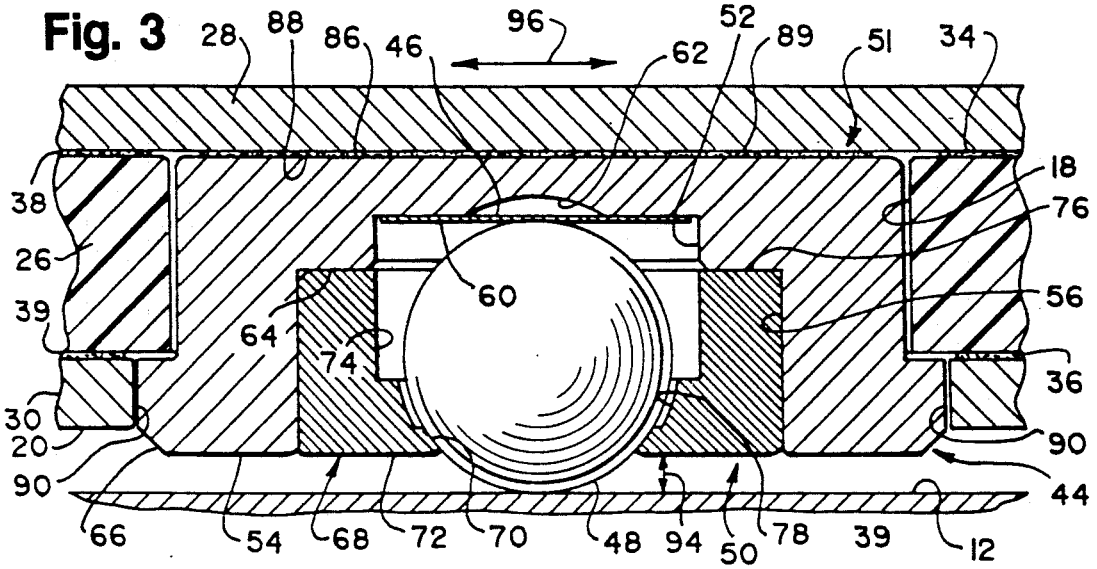
FIGS. 3, 4 and 5 are enlarged fragmentary sectional views taken substantially on line 3—3 of FIG. 2 and showing various dispositions of the instrument during use thereof.

The skin laminae 28 and 30 preferably are relatively thin, thereby to minimize the thickness of the body 24. Preferably, the laminae 28 and 30 are constructed of aluminum plate or sheet and are fixedly secured to the central lamina 26, as by adhesives. As seen in FIG. 3, the adhesive conveniently, and preferably, may be in the form of double-sided adhesive film, shown generally at 38 and 39, interposed between respectively mutually adjacent surfaces of the central lamina 26 and the skin laminae 28 and 30.

The outer surface of the lower skin lamina 30 comprises the inner or bottom face surface 20 of the triangle body 24. The face surface 20 opposes and extends over the drawing surface 12 during normal use of the triangle 10. The outer surface of the upper skin lamina 28 comprises the top or outer surface 40 of the triangle body 24. A shallow depression 42 is formed in the surface for receiving the finger of a user of the triangle 10, for guide purposes.

Referring to FIGS. 2-5, the cartridge assembly 16 includes a ball receiver 44, a flat spring 46, a load-bearing ball 48, and a plug-like ball retainer 50.

The receiver 44 is generally cylindrical and tubular in shape and receives snugly and telescopically therein the cylindrical, tubular retainer 50. The receiver and retainer as joined together constitute a casing generally indicated by the numeral 51.

The receiver 44 is provided with a cylindrical blind bore 52 extending inwardly of the lower surface 54 of the receiver and terminating in a roof or end wall surface 60. A dome-shaped depression 62 is formed in the surface 60. A counterbore 56 extends inwardly from the lower receiver surface 54. An annular shoulder 64 is formed in the receiver 44 at the inner termination of the counterbore. A radially-outwardly extending peripheral flange 66 is formed integrally as part of the receiver 44, adjacent to the lower receiver surface 54.

The ball retainer 50 is provided internally at its lower end 68 with an annular seat 70 for rollably bearing the ball 48. The seat 70 defines a circular opening or aperture 71 in the retainer 50 at its lower surface 72. The seat 70 and the ball 48 are dimensioned for protrusion or projection of a portion only of the ball through the aperture 71 and beyond the lower surface 72 of the retainer when the ball is seated.

A cylindrical bore 74, coaxial with, and of greater diameter than, the seat 70 extends downwardly in the retainer 50 from its inner or top surface 76. The diameter of the bore 74 is substantially equal to that of the bore 52 of the receiver. A radially outwardly extending annular recess 78 is provided in the lower portion of the retainer 50, the recess having radial dimensions intermediate those of the retainer bore 74 and the seat 70.

The receiver 44 and retainer 50 preferably are made of plastic material, more preferably of 10% glass—filled ABS plastic.

Figure 6:
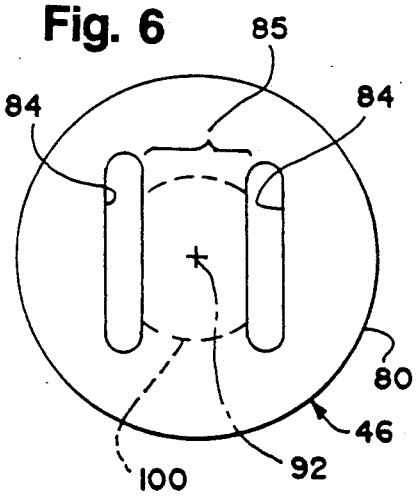
FIG. 6 is a top plan view of a spring element of the instrument.

Referring to FIG. 6, the spring 46 preferably comprises a flat circular disc 80 of spring steel having a diameter substantially equal to that of the receiver bore 52. Two parallel enclosed elongate slots 84 extend through the disc, defining between them a relatively narrow elongate disc section 85.

The ball 48 is spherical and has a diameter less than the diameters of the receiver bore 52 and the retainer bore 74. The ball preferably is constructed of relatively non-deformable material, such as metal or rigid plastic, adapted for low-friction rolling on a drawing surface.

The cartridge assembly is fitted together by first abutting the spring 46 against the roof wall surface 60 of the receiver 44. The spring may be held in position against the roof wall by conventional means such as adhesives or press-fit friction of the circumference of the spring with the wall of the bore 52. The ball 48 then is placed in the receiver 44 and is retained or captured therein by telescopic reception of the retainer 50 in the counterbore 56 of the receiver.

The receiver and retainer are so dimensioned that, when the retainer is properly received in the receiver, the annular shoulder 64 of the receiver abuts the top surface 76 of the retainer 50, and the lower surface 54 of the receiver is substantially coplanar with the lower surface 72 of the retainer. Also, the receiver bore 52 and the retainer bore 74 form a substantially continuous bore within which the ball 48 may move reciprocally between the spring 46 and the seat 70.

The retainer 50 and receiver 44 preferably are secured together by conventional plastics-securing means such, e.g., as adhesives, or solvent, sonic, or thermal welding, or they may be press-fit together.

A cartridge assembly 16 is inserted into each body bore 18. Each bore 18 extends between the upper and lower surfaces 34 and 36, respectively, of the central lamina 26, and includes a counterbore 90 in the lower lamina 30. The upper surface 86 of the receiver 44 is secured to the lower surface 88 of the upper skin lamina 34 by adhesive, such as doublesided adhesive film 89. The upper surface of the receiver flange 66 abuts the lower surface 36 of the central lamina. The periphery of the flange is accommodated in the counterbore 90. The central and lower laminae 26 and 30, and the cartridge assembly 16, are so dimensioned that, when the assembly 16 is carried in the triangle body 24, the lower surface 54 of the receiver and the lower surface 72 of the retainer are substantially coplanar and lowermost or innermost on the triangle body 24.

As seen in FIGS. 3 and 6, in an initial state, with the triangle 10 resting on the drawing surface 12, the upper surface of the ball 48 is in substantially tangential, point (at 92) contact with the spring 46 and the section 85 thereof. The ball is yieldably constrained by the spring 46 in a position seated on the seat 70. A portion of the ball protrudes from the seat 70, a distance (indicated by the arrow 94) beyond the lower surface 72 of the retainer 50. The triangle body 24 consequently is rollably spaced apart and supported substantially the distance 94 from the drawing surface 12.

In use, the draftsman moves the triangle 10 in generally translational movement relative to the drawing surface, as indicated by the arrow 96 (FIG. 3). The frictional contact between the spring 46 and ball 48, when substantially no pressure is exerted on the instrument toward the drawing surface, is insufficient substantially to inhibit rotation of the ball on the seat 70 and rolling movement of the ball on the drawing surface 12.

Figure 4:
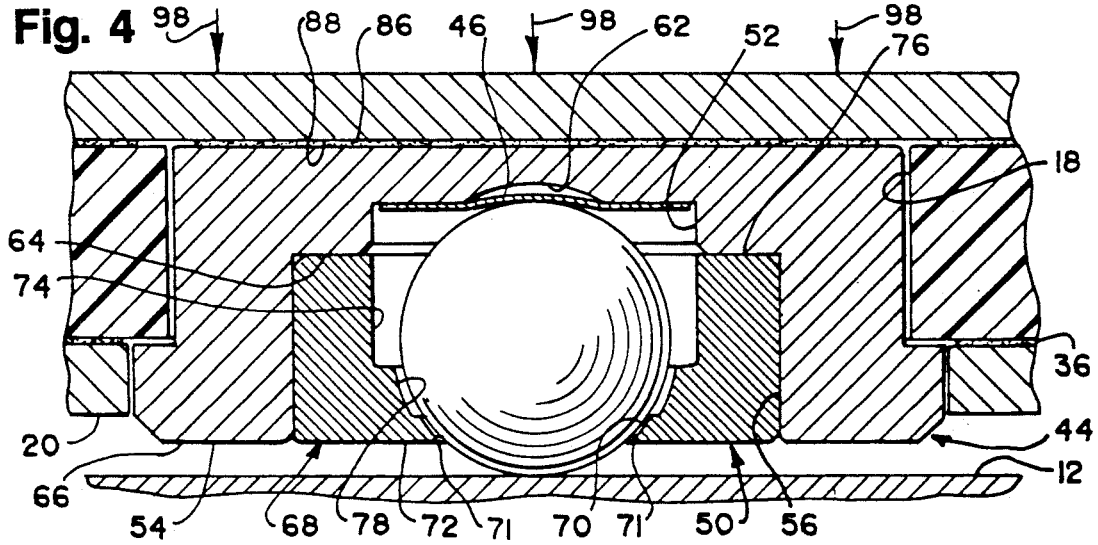
Figure 5:
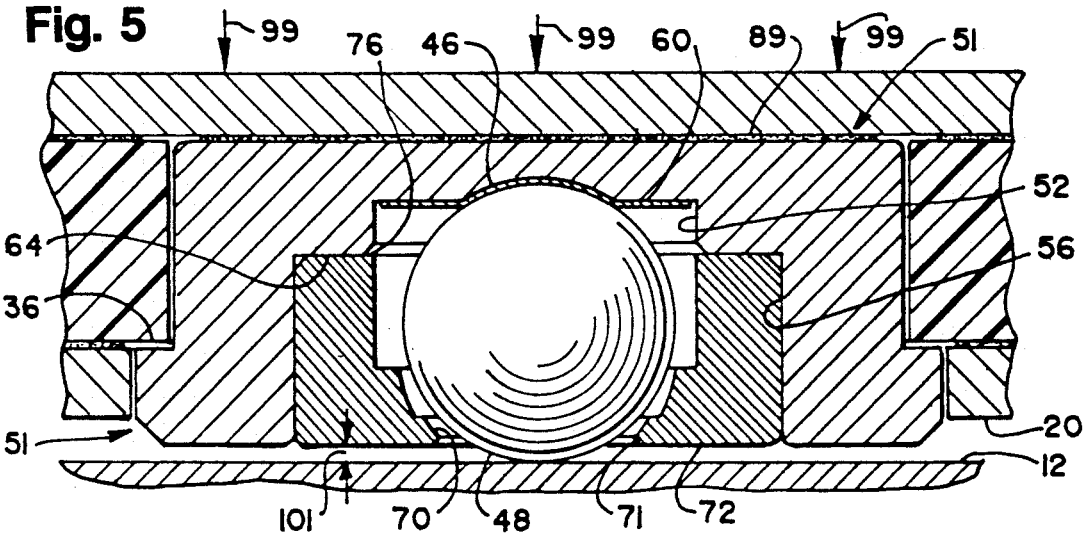

When it is desired to hold the instrument immobile, or in a stationary position, for use as a guide for scribing lines, the draftsman presses the instrument toward the drawing surface. FIGS. 4 and 5 illustrate the behavior of the assembly as such pressure is applied. When pressure is first applied (FIG. 4), as indicated by arrows 98, the ball 48 is forced away from the seat 70 and unseated thereon, moved in a direction into the receiver 44, and moved against the spring 46, which yields to accommodate the ball and frictionally contacts the ball over increasingly greater areas of the spring and the ball, as the spring is urged into the dome-shaped depression 62.

When sufficient pressure is applied (FIG. 5), as indicated by arrows 99, the ball is moved into the receiver 44 until the movement is stopped by deformation of the spring into substantially full contact with the dome 62. When the spring is so deformed, relatively large respective areas of the ball and of the spring are in contact, primarily in the region of the section 85 of the spring, as shown diagrammatically in phantom lines at 100 in FIG. 6. This large area contact or engagement between the ball and spring under applied downward or inward pressure serves frictionally to lock, or to substantially completely inhibit, the ball against rolling movement, thus rendering the triangle 10 substantially immobile. When in its locked position, the ball protrudes beyond the lower surface 72 of the retainer a distance indicated in FIG. 5 by the arrow 101, with the body 24 spaced apart from and supported above the drawing surface 12 substantially the distance 101.

When the draftsman releases the pressure on the triangle 10, the spring 46 urges the ball 48 toward the seat 70 until the initial state illustrated in FIG. 3 is reattained. The triangle then may rollably be moved on the drawing surface.

The cartridge assembly 16 is dimensioned to provide an initial spacing distance 94 which is sufficiently great to clear the drawing surface 12 and foreign material thereon, to at least minimize marring of the drawing as it moves over the surface. The immobile spacing distance 101 is selected to permit the instrument to be positioned close enough to the drawing surface to provide an accurate guide for scribing lines, yet still distant enough from the surface to avoid marring the drawing and, preferably, avoid transfer of bleeding ink to the surface. Exemplary initial and immobile distances 94 and 101, respectively, are 1/32 inch and 1/64 inch.

It will be seen that the spring 46 of the illustrative preferred embodiment performs dual functions: it yieldingly constrains the ball 48 in its rolling position, and it applies a frictional braking force to the ball in its locked position. It will be apparent to those skilled in the art that, alternatively, other resilient means and frictional braking means may be employed. For example, a spring may be employed that allows a portion of the ball to come into frictional, braking contact with another, high-friction surface on the receiver 44.

Figure 8:
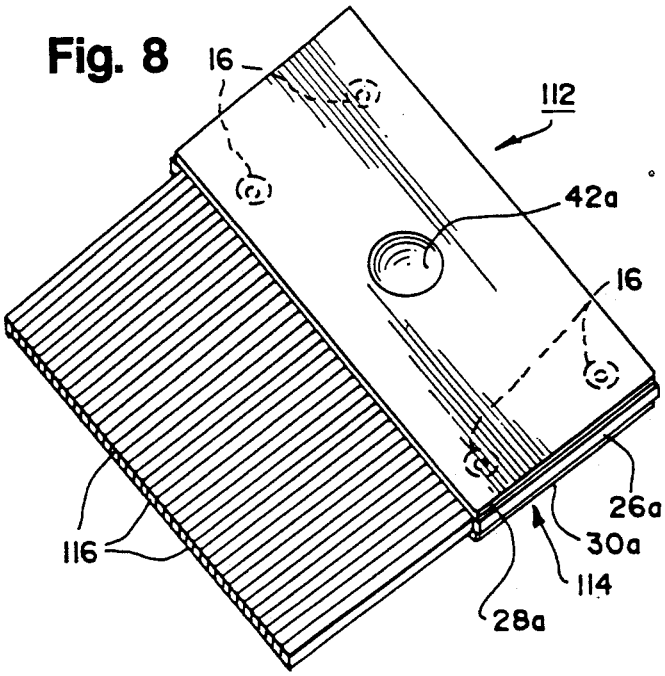
FIG. 8 is a top perspective view of yet another embodiment of a drawing instrument in accordance with the invention.
Figure 7:
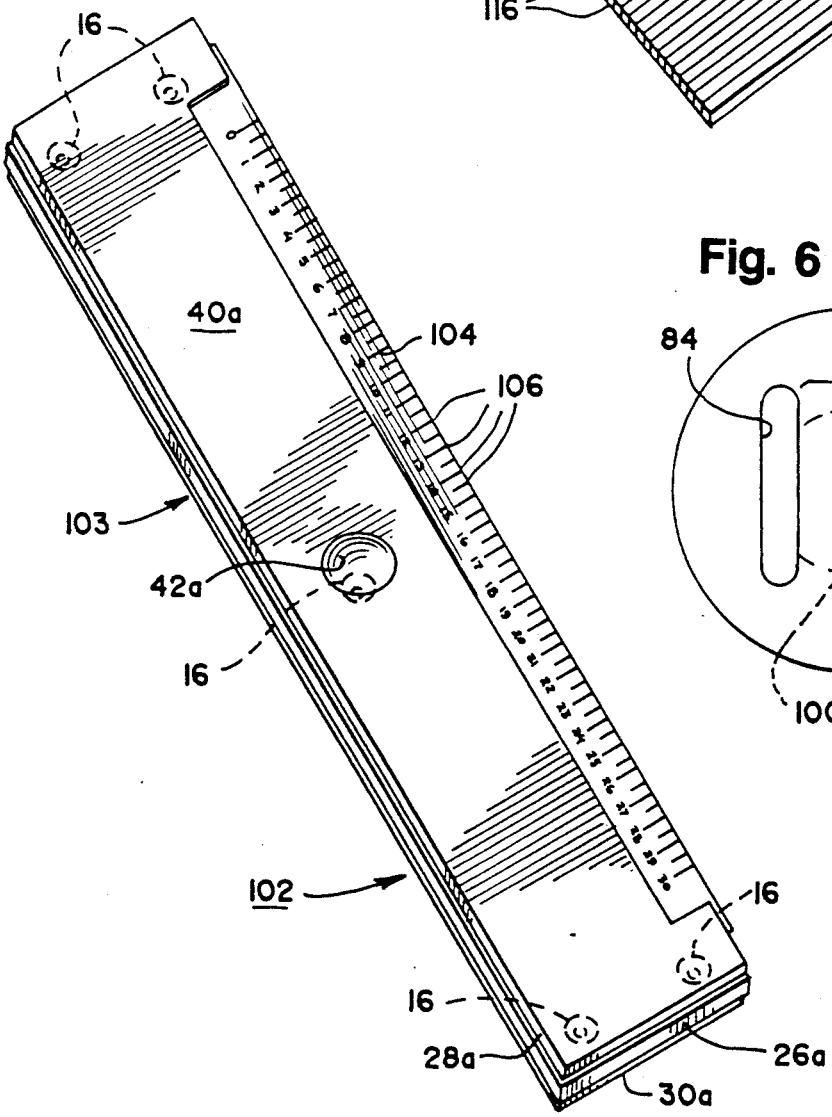
FIG. 7 is a top perspective view of another embodiment of a drawing instrument in accordance with the invention.

FIGS. 7 and 8 illustrate other embodiments of a drawing instrument in accordance with the invention. In describing these embodiments, certain components corresponding to those of the hereinabove-described embodiment of FIGS. 1–6 will be referred to by the same reference numerals followed by the letter "a."

Referring to FIG. 7, the rectangular body 103 of a rectangularly-shaped laminated draftsman's scale 102 is formed of a central lamina **26*a* and upper and lower, or outer and inner, skin laminae, 28*a* and 30*a*, respectively. A finger-receiving depression 42*a* is formed in the top surface 40*a* of the upper skin lamina. A measuring element or rule 104 is mounted in a longitudinally-extending edge of the scale body, the element having indicia 106 indicating length inscribed thereon. A cartridge assembly 16 (as illustrated in FIGS. 1–6) is mounted adjacent to each of the corners of the scale body, and one assembly is mounted centrally of the scale body. The several assemblies are carried in bores 18*a*** (not shown) extending inwardly from the bottom or inner surface of the scale body.

Referring to FIG. 8, a contour drawing gauge 112 includes a rectangular handle 114 and guide fingers 116 adjustably mounted to extend laterally from the handle for variable distances. The handle is of trilaminar construction, including a central lamina **26*a* and upper and lower, or outer and inner, skin lamina 28*a* and 30*a*, respectively. A finger-receiving depression 42*a* is formed in the top surface 40*a* of the handle. A transversely spaced apart cartridge assembly 16 (as illustrated in FIGS. 1–6) is mounted adjacent to each of the corners of the handle and carried in body bores 18*a*** (not shown) extending inwardly from the bottom or inner surface of the handle.

While preferred embodiments of the drawing instrument of the invention have been described and illustrated, it will be apparent to those skilled in the art that various changes and modifications may be made therein within the spirit and scope of the invention. It is intended that all such changes and modifications be included within the scope of the claims.

I claim:

1. A drawing instrument comprising:
   an instrument body,
   a rolling member adapted for supporting said body on a drawing surface,
   means mounting said rolling member on said body for relative movement to and from the body between respective rolling and locked positions of the member projecting from the body,
   resilient means on said body yieldingly constraining said rolling member in said rolling position,
   said resilient means yielding for relative movement of the rolling member into said locked position upon application of pressure to said body in the direction of such drawing surface, and comprising also
   frictional braking means on said body engaging said rolling member in said locked position,
   whereby the instrument may be moved relatively on a drawing surface on which said body is supported with said rolling member in said rolling position and rendered substantially immobile with the rolling member in said locked position, while said instrument body remains in spaced apart relation to the drawing surface.

2. A drawing instrument as defined in claim 1 and wherein said rolling member comprises a load-bearing ball, and said resilient means comprises a flat spring.

3. A drawing instrument as defined in claim 2 and wherein said spring also functions to provide said braking means.

4. A drawing instrument as defined in claim 3 wherein said instrument is a drawing triangle, and a said rolling member is mounted adjacent to each vertex thereof.

5. A non-marring drawing instrument for use supported on a drawing surface or the like which comprises:
   an instrument body adapted for use while extending over a drawing surface; and
   a cartridge assembly carried by said body for supporting the body on such drawing surface, and comprising:

a casing having ball retainer means adjacent to one end thereof, said retainer means including a seat defining an opening in the retainer means, a resilient member mounted within said casing in spaced apart relation to said seat, and a load bearing ball disposed in the casing between said seat and said resilient member and mounted for relative movement reciprocally therebetween, said resilient member yieldingly constraining said ball in a position seated on said seat with a portion of the ball protruding through said opening to rollably support said body on such drawing surface in spaced apart relation thereto, said resilient member yielding for relative movement of said ball in a direction towards the member while the ball continues to protrude through said opening upon pressing said body towards such drawing surface, whereby a frictional braking force is applied to said ball by said resilient member for immobilizing the instrument while said body remains spaced apart from the drawing surface.

6. A drawing instrument as defined in claim 5 and wherein said casing comprises receiver means joined to said retainer means, and said resilient member comprises a flat spring interposed between said receiver means and said ball.

7. A drawing instrument as defined in claim 6 and wherein said body comprises at least two laminae, at least one of said laminae having formed therein a bore for carrying said cartridge assembly.

8. A drawing instrument as defined in claim 7 and wherein said instrument comprises a drawing triangle and carries one said cartridge assembly in a said bore adjacent to each vertex thereof.

9. A drawing instrument as defined in claim 7 and wherein said instrument comprises a rectangularly-shaped draftsman's scale, and said scale carries one said cartridge assembly in a said bore adjacent to each corner thereof.

10. A cartridge assembly adapted to be carried by a drawing instrument body for supporting the body on a drawing surface or the like which comprises:

a casing having ball retainer means adjacent to one end thereof, said retainer means including a seat defining an opening in the retainer means, a resilient member mounted within said casing in spaced apart relation to said seat, and a load-bearing ball disposed in said casing between said seat and said resilient member and mounted for relative movement reciprocally therebetween, said resilient member yieldingly constraining said ball in a position seated on said seat with a portion of the ball protruding through said opening for rollably supporting a drawing instrument body carrying the cartridge assembly on a drawing surface in spaced apart relation thereto, said resilient member yielding for relative movement of said ball in a direction toward the member while the ball continues to protrude through said opening upon pressing such drawing instrument body towards such drawing surface, whereby a frictional braking force is applied to said ball by said resilient member for immobilizing the instrument while such body remains spaced apart from the drawing surface.

11. A cartridge assembly as defined in claim 10 and wherein said casing comprises receiver means joined to said retainer means, and said resilient member comprises a flat spring interposed between said receiver means and said ball.

* * * * *